US007096972B2

(12) United States Patent
Orozco, Jr.

(10) Patent No.: US 7,096,972 B2
(45) Date of Patent: Aug. 29, 2006

(54) HAMMER DRILL ATTACHMENT

(76) Inventor: Efrem Orozco, Jr., 30 Country Manor La., Orland Park, IL (US) 60467

( * ) Notice: Subject to any disclaimer, the term of this patent is extended or adjusted under 35 U.S.C. 154(b) by 0 days.

(21) Appl. No.: 10/244,858

(22) Filed: Sep. 17, 2002

(65) Prior Publication Data

US 2004/0050568 A1 Mar. 18, 2004

(51) Int. Cl.
*B25D 16/00* (2006.01)

(52) U.S. Cl. ..... 173/171; 173/148; 173/114; 173/122; 173/132; 173/128

(58) Field of Classification Search ..... 173/48, 173/90, 101, 114, 122, 132, 128, 171, 100; 175/293, 414, 320; 279/19.6, 19.7, 19.3, 279/19.5, 19.2; 30/277
See application file for complete search history.

(56) References Cited

U.S. PATENT DOCUMENTS

| | | | | | |
|---|---|---|---|---|---|
| 836,376 | A | * | 11/1906 | Fancher | 279/83 |
| 2,716,393 | A | * | 8/1955 | Fischer | 279/19.5 |
| 2,984,241 | A | * | 5/1961 | Carlson | 30/277 |
| 3,097,858 | A | * | 7/1963 | Amundsen et al. | 279/19.1 |
| 3,161,241 | A | * | 12/1964 | Allen et al. | 173/48 |
| 3,802,518 | A | * | 4/1974 | Albert | 173/29 |
| 4,007,795 | A | | 2/1977 | Gawron | |
| 4,332,300 | A | * | 6/1982 | Scarton et al. | 173/104 |
| 4,545,440 | A | * | 10/1985 | Treadway | 173/132 |
| 4,585,077 | A | * | 4/1986 | Bergler | 173/48 |
| 4,621,818 | A | * | 11/1986 | Rohm | 279/19.5 |
| 4,700,956 | A | * | 10/1987 | Rohm | 173/48 |
| 4,903,785 | A | * | 2/1990 | Odoni et al. | 175/293 |
| 5,042,592 | A | * | 8/1991 | Fisher | 173/109 |
| 5,522,606 | A | * | 6/1996 | Pressley et al. | 173/132 |
| 5,806,609 | A | * | 9/1998 | Stock et al. | 173/205 |
| 5,992,538 | A | * | 11/1999 | Marcengill et al. | 173/171 |
| 6,196,330 | B1 | * | 3/2001 | Matthias et al. | 173/48 |
| 6,443,238 | B1 | * | 9/2002 | Paterson et al. | 173/1 |

* cited by examiner

*Primary Examiner*—Louis K. Huynh
*Assistant Examiner*—Michelle Lopez

(57) ABSTRACT

Power tools of the type under consideration include hammer drills, for example, which are electric or battery powered and includes two modes of operation: a rotation mode and a rotation-hammer mode. A manually operable selector lever enables the hammer drill to be selectively operated in one of the two modes by disengaging and engaging a hammer mechanism. In rotation-hammer mode, the drive shaft of the hammer drill rotates a tool element about a rotational axis and oscillates the tool element along a rotational axis. An attachment mountable within the chuck of a hammer drill prevents a tool element from rotating when the hammer drill is operating in rotation-hammer mode. The hammer drill attachment transfers hammer action, but not rotation, to the tool element. The hammer drill attachment enables dual function power tools to be operated in a hammer only mode to perform a function, for example, chiseling.

5 Claims, 5 Drawing Sheets

HAMMER DRILL ATTACHMENT

FIELD OF THE INVENTIONS

The present invention relates generally to power tools. More specifically, the present invention relates to attachments for power tools having hammer mechanisms and selectively operable in either a rotation mode or rotation-hammer mode.

BACKGROUND OF THE INVENTIONS

Power tools of the type under consideration include hammer drills, for example, which are electric or battery powered and includes two modes of operation: a rotation mode and a rotation-hammer mode. A manually operable selector lever enables the hammer drill to be selectively operated in one of the two modes by disengaging a hammer mechanism when the selector lever is placed in a first position and engaging the hammer mechanism when the selector lever is placed in a second position.

When the selector lever is placed in the first position, the power tool operates in a rotation action mode. This mode is selected for rotating a tool element, such as a drill bit, in order to drill a hole in material such as wood or plaster.

When the selector lever is placed in the second position, the power tool operates in a rotation-hammer action mode in which a hammer action works in combination with rotation to rotate and hammer a tool element. One well-known use of the simultaneous rotation and hammer action of the rotation-hammer mode is to drill a hole in resistant material such as steel or concrete. When the power tool operates in the rotation-hammer mode, the operator must exert a pressing force or contact pressure to the tool element positioned in the chuck in order to actuate the hammer mechanism.

The manually operable selector lever determines operation of such hammer drills having the dual function of rotation mode and rotation-hammer mode. Operators of these dual function power tools often find it necessary to perform work that requires the tool to be operated solely in a hammer action mode, such as chiseling. However, a sole hammer action mode is not available in such dual function power tools. Although power tools, such as rotary hammers, exist with three modes of operation: a rotation mode, a rotation-hammer mode, and a hammer or chiseling mode, these power tools are more expensive than the dual mode power tools discussed above. An object of the present invention is to enable dual function power tools, such as hammer drills having a rotation mode and a rotation-hammer mode, to be operated in a hammer only mode.

The various aspects, features and advantages of the present invention will become more fully apparent to those having ordinary skill in the art upon careful consideration of the following Detailed Description of the Inventions with the accompanying drawings described below.

SUMMARY OF THE INVENTIONS

An object of the present invention is to provide an additional mode of operation, a hammer only action mode, to power tools such as hammer drills that only have two modes of operation: a rotation mode and a rotation-hammer mode. The present invention may be summarized as an attachment mountable within the chuck of a hammer drill. The hammer drill attachment comprises a body having a longitudinally extending inner portion with a first end and a second end and a drill member positioned within the second end of body, wherein drill member longitudinally oscillates along a rotational axis between a first position and a second position within body. In rotation-hammer mode, the drive shaft of the hammer drill rotates the drill member about a rotational axis and oscillates the drill member along a rotational axis.

According to the present invention, the hammer drill attachment prevents a tool element positioned in the first end of the body from rotating when the hammer drill is operating in rotation-hammer mode. The operator exerts a pressing force or contact pressure to engage the hammer mechanism of the hammer drill. The hammer drill attachment transfers hammer action, but not rotation, to the tool element. An object of the present invention is to enable dual function power tools, such as hammer drills having a rotation mode and a rotation-hammer mode, to be operated in a hammer only mode. Preferable embodiments for mere illustration will be described as follows.

DETAILED DESCRIPTION OF THE INVENTIONS

Figure 1:
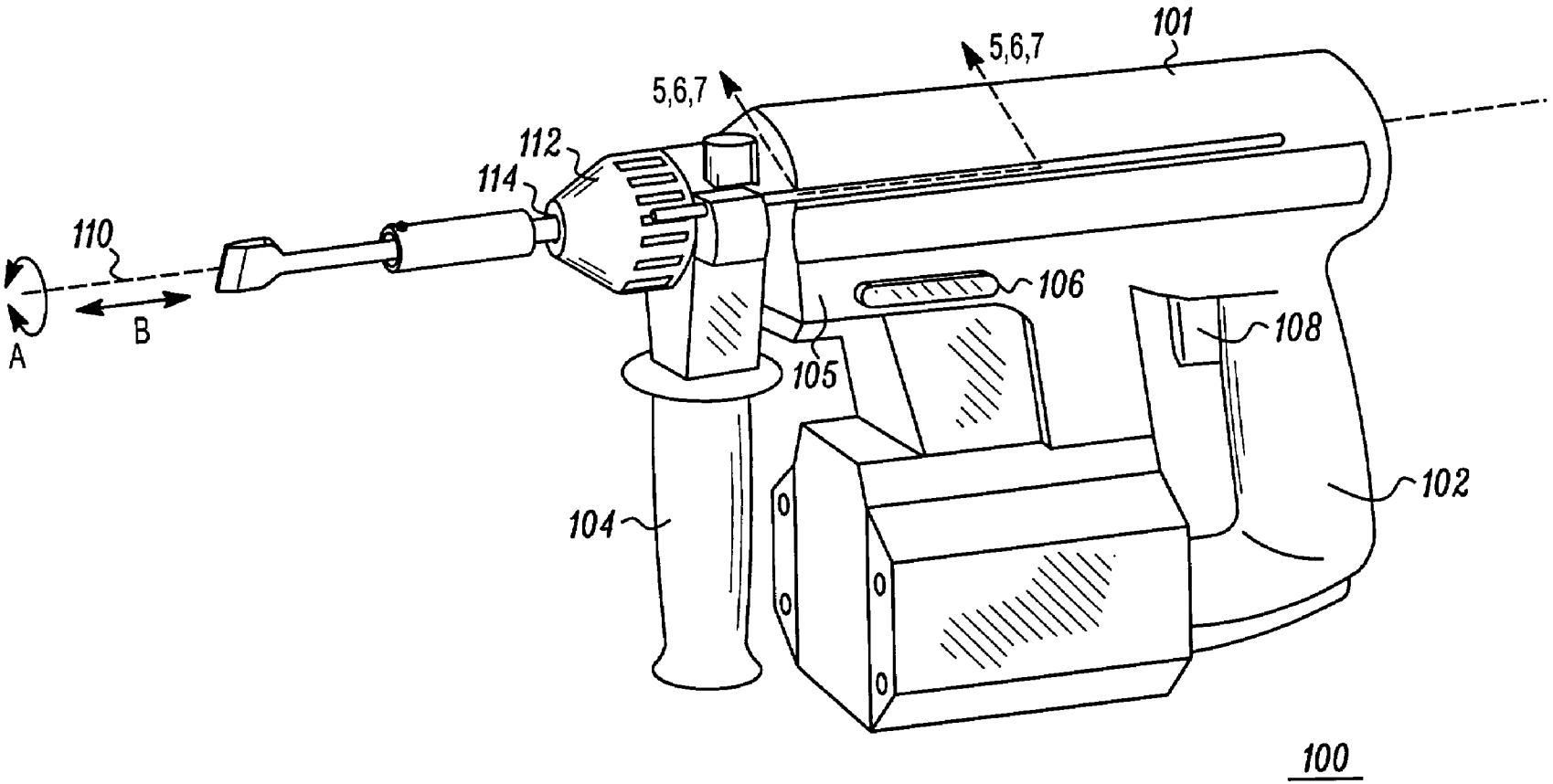
FIG. 1 is a schematic diagram of a hammer drill according to the present invention.
Figure 5:
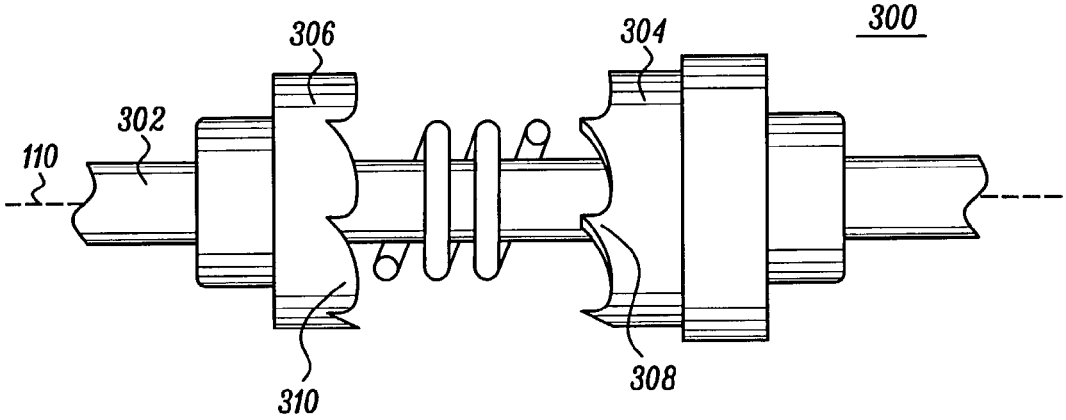
FIG. 5 is a cross sectional view of a hammer mechanism in rotation action mode.

FIG. 1 is a schematic diagram of a hammer drill according to the present invention. As illustrated in FIG. 1, a hammer drill 100 includes a handle 102 as well as an optional auxiliary handle 104 to enable an operator to grasp hammer drill 100 during operation. A housing 101 includes the inner workings of hammer drill 100 including a motor and a hammer mechanism 300 (FIG. 5). A manually operable selector lever 106 engages and disengages the hammer mechanism so that when selector lever 106 is placed in a first position relative to a side portion 105 of hammer drill 100, hammer drill 100 operates in a rotation action mode, and when selector lever 106 is placed in a second position relative to side portion 105, hammer drill 100 operates in a rotation-hammer action mode. A trigger 108 is used to actuate an electric, battery powered, or pneumatic motor (not shown) of hammer drill 100.

Engagement of trigger 108 by an operator drives the motor at variable speeds, dependant upon the amount of force exerted by the operator to press trigger inward towards handle 102, thereby actuating the electric, battery powered, or pneumatic motor to drive the drive shaft 302 (FIG. 5). When manually operable selector lever 106 is in the first position, drive shaft 302 is rotatable about a rotational axis 110 in a direction indicated by arrow A. When manually operable selector lever 106 is in the second position, drive shaft 302 is rotatable about rotational axis 110 in direction indicated by arrow A and longitudinally oscillates along rotational axis 110 in a direction indicated by arrow B. In order for drive shaft 302 to longitudinally oscillate along rotational axis 110 in the direction of arrow B, the operator must exert a pressing force or contact pressure to a tool element positioned in a drill chuck 112.

Drill chuck 112 mounts on drive shaft 302 of hammer drill 100 and includes a receptacle 114 having a plurality of jaws that secure the shank of the tool element, described in detail below, when the tool element is positioned within chuck 112. There are several methods for securing the tool element into chuck 112, such as through the use of a keyed chuck, a keyless chuck, or a quick-connection mechanism. A keyed chuck has a plurality of ridges around the base circumference of chuck 112. A key, which is inserted within a side of chuck 112, has ridges that mate with the ridges around the base circumference of chuck 112. The ridges of the key move within the ridges around a base circumference of chuck 112 so that when the key is rotated counter-clockwise, a plurality of jaws within a chuck receptacle 114 open as to enable the shank of the tool element to be inserted within chuck 112 at chuck receptacle 114. Once the tool element is positioned within chuck 112, the key is rotated clockwise to secure the shank of the tool element by fixedly engaging the plurality of jaws within chuck receptacle 114 around shank of tool element.

With a keyless chuck, chuck 112 rotates counter-clockwise to open the plurality of jaws within receptacle 114 to enable the tool element to be inserted within chuck 112 at chuck receptacle 114. Chuck 112 is rotated counter-clockwise either manually or by pressing trigger 108 in a reverse mode. Once the tool element is positioned within chuck 112, chuck 112 is rotated clockwise to secure the shank of tool element by fixedly engaging the plurality of jaws within chuck receptacle 114 around shank of tool element. Chuck 112 is rotated clockwise either manually or by pressing trigger 108 in the drive mode.

With a quick-connection chuck, chuck 112 is pressed backward to open the plurality of jaws within chuck receptacle 114. The plurality of jaws are keyed with SDS grooves or a hexagonal configuration. Once the tool element is inserted, chuck 112 is released to the original position securing the shank of tool element. Tool element shanks have SDS grooves used in conjunction with a SDS quick-connection chuck or a hexagonal contour used in conjunction with a hexagonal configured chuck.

Hammer drills have, but are not limited to, a ⅜", ½", ¾", or 1" chuck which designates the maximum size of the tool element shank that can be inserted into chuck receptacle 114. Therefore, the tool elements to be used in conjunction with these hammer drills must have either a ⅜", ½", ¾", or 1" respectively or lesser size shank in order to engage into chuck 112. Most power tools designate the maximum size diameter of the shaft of the tool element that can be inserted into chuck receptacle 114.

Figure 2:
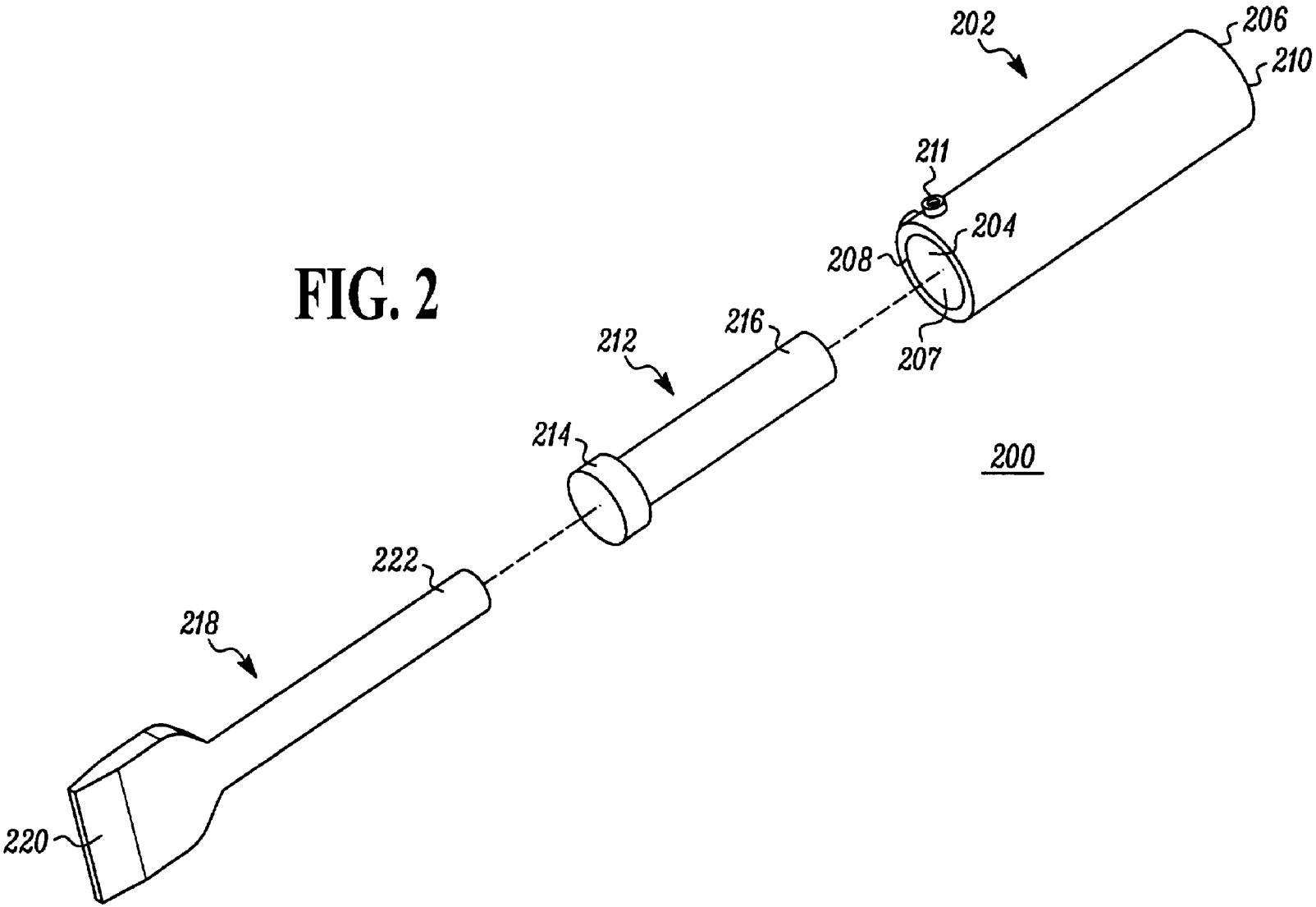
FIG. 2 is an exploded schematic diagram of a hammer drill attachment for use with the hammer drill of FIG. 1 in accordance to a preferred embodiment of the present invention.

FIG. 2 is an exploded schematic diagram of a hammer drill attachment for use with the hammer drill of FIG. 1 in accordance to a preferred embodiment of the present invention. As illustrated in FIG. 2, a hammer drill attachment 200 that allows a hammer drill operating in the rotation-hammer mode to exert a hammer only action to a tool element includes a longitudinal body 202 and a drill member 212. Longitudinal body 202 extends from a first end 204 to a second end 206. According to the present invention, body 202 is cylindrical, but is not limited thereto. Body 202 has a first opening 208 and a second opening 210 forming a longitudinally extending inner portion 207 extending from first end 204 to second end 206 for inserting a drill member 212 within body 202.

Shaft 216 of drill member 212 extends outward from a base end 214 of drill member 212. Base end 214 has a diameter that enables base end 214 to be inserted in first opening 208 of body 202 through inner portion 207 so that shaft 216 extends outside body 202 through second opening 210 at second end 206 and base end 214 is positioned in inner portion 207 at second end 206. Shaft 216 can be of any size diameter, for example ⅜" or ½", to fit within a keyed chuck, keyless chuck, or quick-connection receptacle. In an alternate preferred embodiment, shaft 216 has a SDS configuration or hexagonal contour to engage into a SDS quick-connection chuck or hexagonal contour quick-connection chuck, respectively. The quick-connection allows for rapid loading and unloading of drill member 212 into receptacle 114 of chuck 112.

Tool element 218 is selected to perform the function the operator desires, and includes a working end 220 and a shank 222. Shank 222 has a diameter that enables shank 222 to be inserted within first opening 208 of body 202. Working end 220 of tool element 218 makes contact with the working surface. Working end 220 can be of varying shapes and sizes in order to perform the function the operator desires, for example a chisel.

Figure 3:
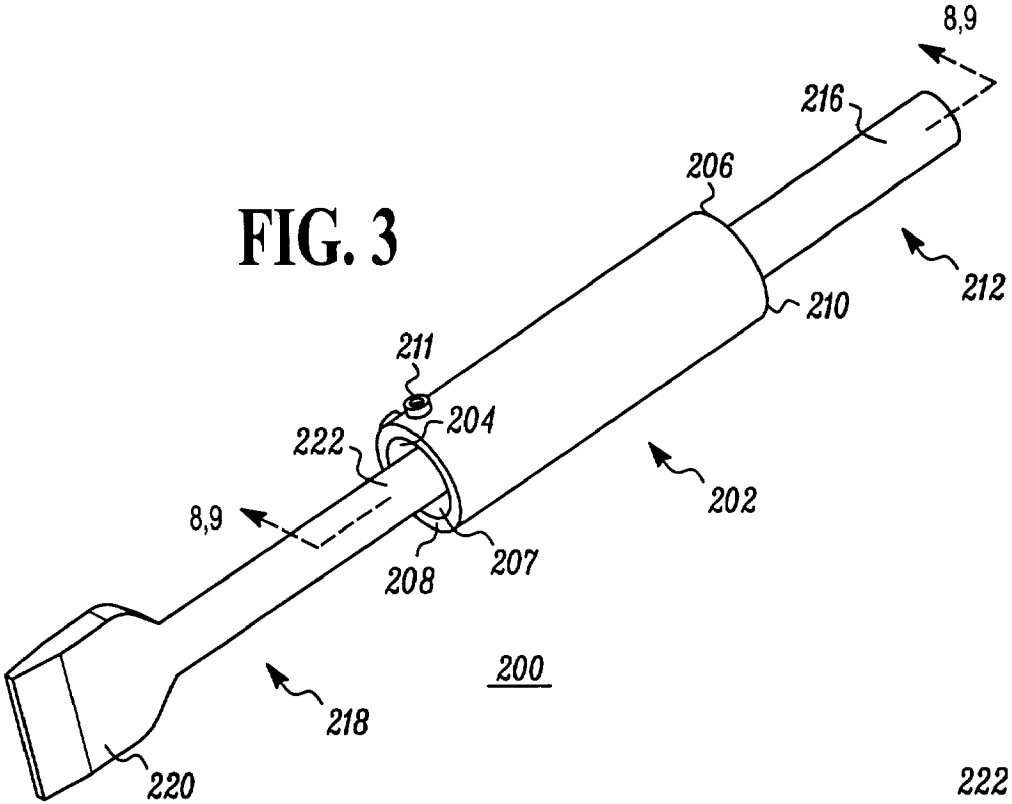
FIG. 3 is a perspective view of an assembled hammer drill attachment according to a preferred embodiment the present invention.

FIG. 3 is a perspective view of an assembled hammer drill attachment according to a preferred embodiment the present invention. As illustrated in FIG. 3 drill member 212 is inserted within first opening 208 and through inner portion 207 of body 202. Drill member 212 is positioned so that base end 214 is positioned within inner portion 207 at second end 206 of body 202 and shaft 216 is extended outside body 202 through second opening 210 at second end 206. Rim 213 (FIG. 8) retains base end 214 of drill member 212 within inner portion 207 of body 202 and prevents base end 214 from extending outside second opening 210 of second end 206. Drill member 212 is free to rotate about rotational axis 110 (FIG. 1) of hammer drill 100 and longitudinally oscillate along rotational axis 110 between first end 204 and second end 206 of inner portion 207 of body 202. Shaft 216 extends outside second end 206 of body 202 so that shaft 216 is insertable within receptacle 114 of chuck 112 (FIG. 1).

Shank 222 of tool element 218 is inserted within first opening 208 of first end 204 of body 202. Tool element 218 is secured within inner portion 207 of body 202 by any means known to those skilled in the art. In a preferred embodiment, shank 222 of tool element 218 is secured within first opening 208 of body 202 with Allen screws by rotating an Allen screw 211 to extend Allen screw 211 within body 202 to fixedly engage shank 222 within inner portion 207 of body 202. In a second embodiment, shank 222 of tool element 218 has a quick-connection configuration, such as a SDS, to mate with a quick-connection configuration of first end 204 of body 202. The quick-connection allows for rapid loading and unloading of tool elements within body 202.

Figure 4:
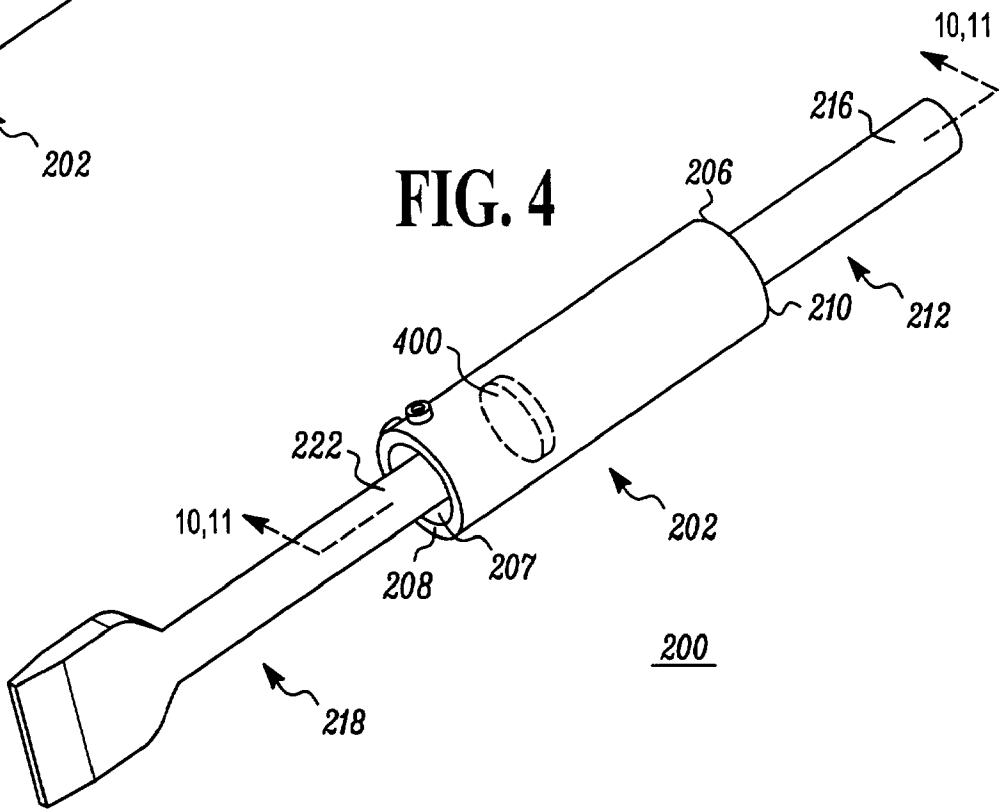
FIG. 4 is a perspective view of an assembled hammer drill attachment in accordance with an alternate preferred embodiment of the present invention.

FIG. 4 is a perspective view of an assembled hammer drill attachment in accordance with an alternate preferred embodiment of the present invention. As illustrated in FIG. 4, according to an alternate preferred embodiment of the present invention, drill member 212 is integrated with body 202. Body 202 includes a section 400 perpendicular to the inner portion 207. Drill member 212 is inserted within first opening 208 and through inner portion 207 of body 202. Drill member 212 is positioned so that base end 214 is positioned within inner portion 207 at second end 206 of body 202 and shaft 216 is extended outside body 202 through second opening 210 at second end 206. Section 400 is welded within inner portion 207 of body 207 to prevent drill member 212 from extending outward from first opening 208 of first end 204 of body 202. Section 400 retains drill member 212 within inner portion 207 of body 202 and prevents base end 214 from departing outside first opening 208 of first end 204. Therefore, body 202 and drill member 212 are integrated as one piece. Rim 213 (FIG. 8) retains base end 214 of drill member 212 within inner portion 207 of body 202 and prevents base end 214 from extending outside second opening 210 of second end 206. Drill member 212 is free to rotate about rotational axis 110 (FIG. 1) of hammer drill 100 and longitudinally oscillate along rotational axis 110 between first end 204 and section 400 of inner portion 207 of body 202. Shaft 216 extends outside second end 206 of body 202 so that shaft 216 is insertable within receptacle 114 of chuck 112 (FIG. 1).

Shank 222 of tool element 218 is inserted within first opening 208 of first end 204 of body 202 so that shank 222 is positioned against section 400 of body 202. Tool element 218 is secured within inner portion 207 of body 202 by any means known to those skilled in the art. In a preferred embodiment, shank 222 of tool element 218 is secured within first opening 208 of body 202 with Allen screws by rotating an Allen screw 211 to extend Allen screw 211 within body 202 to fixedly engage shank 222 within inner portion 207 of body 202. In a second embodiment, shank 222 of tool element 218 has a quick-connection configuration, such as a SDS, to mate with a quick-connection configuration of first end 204 of body 202. The quick-connection allows for rapid loading and unloading of tool elements within body 202.

According to a preferred embodiment of the present invention, body 202, drill member 212, and tool element 218 are manufactured from, but not limited to, steel or carbide. From the description above, two embodiments of the present invention are possible, but not limited thereto: first, body 202, and drill member 212 are separate parts; second, body 202 and drill member 212 are integrated as one part.

FIG. 5 is a cross sectional view of a hammer mechanism in rotation action mode. Hammer mechanism 300 is located in housing 101 of hammer drill 100. As illustrated in FIG. 5, hammer mechanism 300 includes a drive shaft 302 and two opposing clutches: a fixed clutch 304 and a rotating clutch 306. A series of ramps are located on fixed clutch 304 and rotating clutch 306. Fixed clutch 304 has a first set of ramps 308 and rotating clutch 306 has a second set of ramps 310. Rotating clutch 306 and fixed clutch 304 are not positioned together during rotation only mode. When manually operable selector lever 106 (FIG. 1) is in the first position relative to a side portion 105 (FIG. 1), drive shaft 302 is rotatable about rotational axis 110. Engagement of trigger 108 (FIG. 1) by an operator drives the motor at variable speeds, dependant upon the amount of force exerted by the operator to press trigger inward towards handle 102 (FIG. 1), thereby actuating the electric, battery powered, or pneumatic motor to drive the drive shaft 302. Drive shaft 302 rotates chuck 112 (FIG. 1) and tool element 218 positioned in chuck 112 about rotational axis 110.

Hammer mechanism is engaged when manually operable selector lever 106 (FIG. 1) is in the second position relative to a side portion 105 (FIG. 1) of hammer drill 100. Hammer mechanism 300 is actuated when an operator applies a pressing force or contact pressure to tool element 218 positioned in chuck 112 (FIG. 1) while engaging trigger 108 (FIG. 1). When an operator applies a pressing force or contact pressure to tool element 218 positioned in chuck 112 (FIG. 1), rotating clutch 306 and fixed clutch 304 are positioned together so that second set of ramps 310 on rotating clutch 306 slide up and down first set of ramps 308 on fixed clutch 304 causing drive shaft 302 to longitudinally oscillate along rotational axis 110 from a first position to a second position, creating a hammer action.

Figure 6:
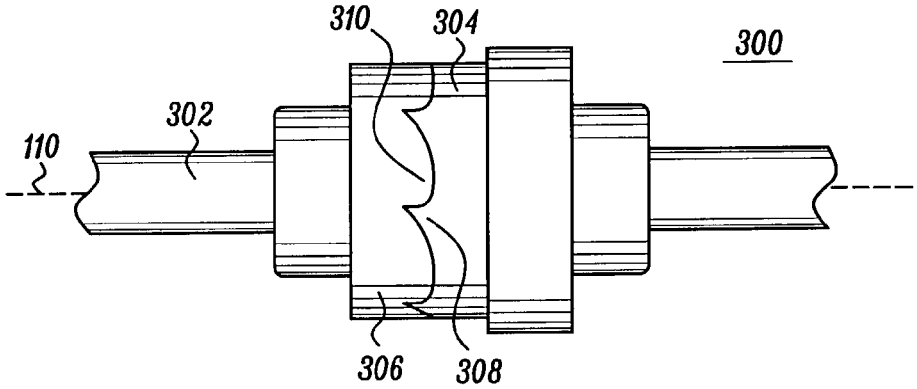
FIG. 6 is a cross sectional view of a hammer mechanism in a first position in rotation-hammer action mode.

FIG. 6 is a cross sectional view of a hammer mechanism in a first position in rotation-hammer action mode. As illustrated in FIG. 6, rotating clutch 306 and fixed clutch 304 are positioned together when the hammer mechanism is actuated. In the first position, drive shaft 302 rotates about rotational axis 110 and drive shaft 302 longitudinally regresses along rotational axis 110 when second set of ramps 310 on rotating clutch 306 slide down first set of ramps 308 on fixed clutch 304.

Figure 7:
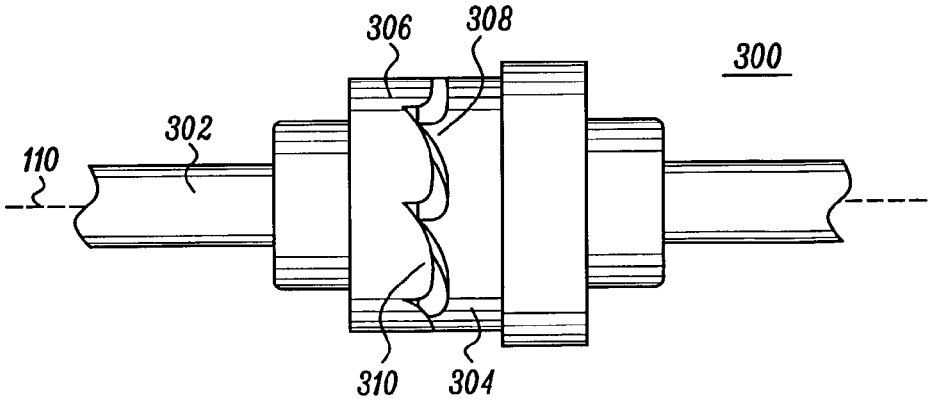
FIG. 7 is a cross sectional view of a hammer mechanism in a second position in rotation-hammer action mode.

FIG. 7 is a cross sectional view of a hammer mechanism in a second position in rotation-hammer action mode. As illustrated in FIG. 7, rotating clutch 306 and fixed clutch 304 are positioned together when the hammer mechanism is actuated. In the second position, drive shaft 302 rotates about rotational axis 110 and drive shaft 302 longitudinally advances along rotational axis 110 when second set of ramps 310 on rotating clutch 306 slide up first set of ramps 308 on fixed clutch 304.

Hammer drill attachment 200 (FIG. 2) is secured by one of the methods described above to hammer drill 100 by inserting shaft 216 of drill member 212 within chuck receptacle 114 (FIG. 1). Shaft 216 has a diameter that enables shaft 216 to be fixedly engaged within chuck receptacle 114. Shaft 216 can be of any size diameter, for example ⅜" or ½", to fit within a keyed chuck, keyless chuck, or quick-connection chuck. In a preferred embodiment, as drill member 212 rotates about rotational axis 110 and longitudinally oscillates along rotational axis 110 within body 202, hammer drill attachment 200 transfers hammer action but not rotation action to tool element 218.

Figure 8:
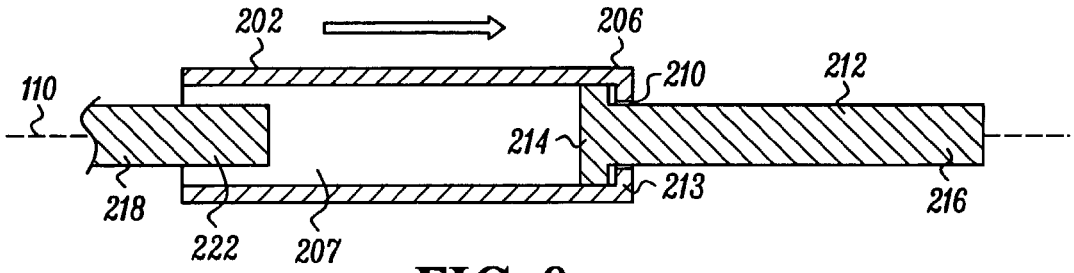
FIG. 8 is a cross sectional view of a hammer drill attachment in a first position in accordance with a preferred embodiment of the present invention.
Figure 9:
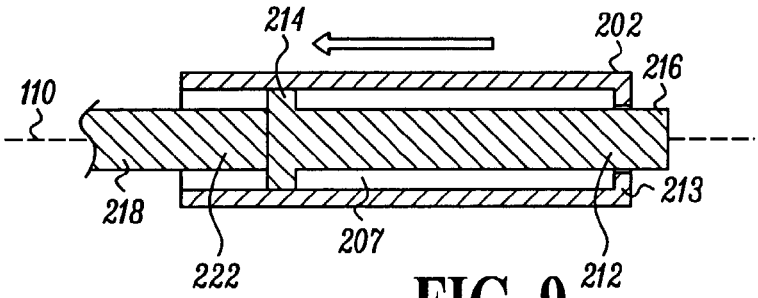
FIG. 9 is a cross sectional view of a hammer drill attachment in a second position in accordance with a preferred embodiment of the present invention.

FIG. 8 is a cross sectional view of a hammer drill attachment in a first position in accordance with a preferred embodiment of the present invention. FIG. 9 is a cross sectional view of a hammer drill attachment in a second position in accordance with a preferred embodiment of the present invention. As the hammer mechanism is actuated so that second set of ramps 310 on rotating clutch 306 slide up and down first set of ramps 308 on fixed clutch 304 (FIG. 6 and FIG. 7), drill member 212 longitudinally advances and regresses along rotational axis 110 through inner portion 207 of body 202 between a first position, in which base 214 of drill member 212 is positioned against second end 206 of body 202, and a second position, in which base 214 of drill member 212 is positioned against shank 222 of tool element 218. When drill member 212 is in the first position, rim 213 retains base end 214 of drill member 212 within body 202 and prevents base end 214 from extending outside second opening 210 of second end 206.

As drill member 212 rotates about rotational axis 110 and longitudinally oscillates along rotational axis 110 within body 202, hammer action is transferred to tool element 218 when drill member 212 longitudinally oscillates between a first position and a second position. Rotation is not transferred to tool element 218 since drill member 212 and tool element 218 are independent parts within body 202. Therefore, a function that requires hammer only action, such as chiseling, can be performed.

Figure 10:
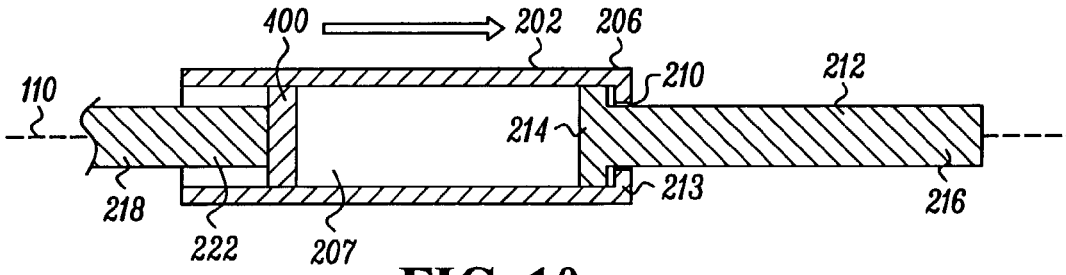
FIG. 10 is a cross sectional view of a hammer drill attachment in a first position in accordance with an alternate preferred embodiment of the present invention.
Figure 11:
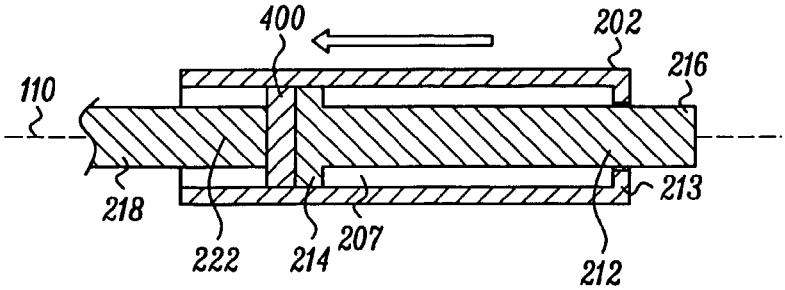
FIG. 11 is a cross sectional view of a hammer drill attachment in a second position in accordance with an alternate preferred embodiment of the present invention.

FIG. 10 is a cross sectional view of a hammer drill attachment in a first position in accordance with an alternate preferred embodiment of the present invention. FIG. 11 is a cross sectional view of a hammer drill attachment in a second position in accordance with an alternate preferred embodiment of the present invention. As the hammer mechanism is actuated so that second set of ramps 310 on rotating clutch 306 slide up and down first set of ramps 308 on fixed clutch 304 (FIG. 6 and FIG. 7), drill member 212 longitudinally advances and regresses along rotational axis 110 through inner portion 207 of body 202 between a first position, in which base 214 of drill member 212 is positioned against second end 206 of body 202, and a second position, in which base 214 of drill member 212 is positioned against section 400 of inner portion 207. When drill member 212 is in the first position, rim 213 retains base end 214 of drill member 212 within body 202 and prevents base end 214 from extending outside second opening 210 of second end 206.

As drill member 212 rotates about rotational axis 110 and longitudinally oscillates along rotational axis 110 within body 202, hammer action is transferred to tool element 218 when drill member 212 moves between a first position and a second position. Drill member 212 transfers hammer action to perpendicular section 400 that in turn delivers hammer action to tool element 218. Rotation is not transferred to tool element 218 since drill member 212 and tool element 218 are independent parts within body 202. Therefore, a function that requires hammer only action, such as chiseling, can be performed.

Body 202 prevents the rotational component of the rotation-hammer action mode from transferring to tool element 218. According to the present invention, body 202 and drill member 212 provide a hammer only mode to dual mode hammer drills.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

What is claimed is:

1. A hammer drill attachment comprising:

a hammer drill, a tool element, and a chuck;

a cylindrical body having a first opening extending to a second opening forming an inner portion;

a rim positioned at said second opening of said body and extending substantially within said inner portion;

said tool element having a shank and a working end, wherein said shank is positioned within said first opening of said body and extending substantially within said inner portion;

a cylindrical drill member with a base end and a shaft, wherein said base end has a substantially larger cylindrical diameter than said shaft;

said base end is positioned within said second opening of said body and extending substantially within said inner portion, said shaft is positioned within said chuck of said hammer drill;

said drill member longitudinally oscillates along a rotational axis through said inner portion from a first position and a second position, wherein said base end of said drill member momentarily and directly abuts said shank of said tool element at said second position and said base end of said drill member momentarily abuts said rim at said first position, wherein said rim retains said base end within said inner portion for preventing rotation of said tool element with respect to said body when said hammer drill is operating in a rotation-hammer mode.

2. The system for preventing rotation to a tool element in the chuck of a hammer drill of claim 1 wherein said tool element is a chisel.

3. The system for preventing rotation to a tool element in the chuck of a hammer drill of claim 1 wherein said shank of said tool element is positioned within said first opening of said body by Allen screws.

4. The system for preventing rotation to a tool element in the chuck of a hammer drill of claim 1 wherein said shank of said tool element is positioned within said first opening of said body by a quick-connection configuration.

5. The system for preventing rotation to a tool element in the chuck of a hammer drill of claim 1 wherein said shaft of said drill member is positioned within said chuck of said hammer drill by a quick-connection configuration.

* * * * *